United States Patent [19]

Saviano

[11] Patent Number: 5,062,324

[45] Date of Patent: Nov. 5, 1991

[54] HAND HAMMER

[76] Inventor: Thomas A. Saviano, 13866 Skyline Blvd., Woodside, Calif. 94062

[21] Appl. No.: 578,727

[22] Filed: Sep. 4, 1990

[51] Int. Cl.[5] ..... B25C 1/00

[52] U.S. Cl. ..... 81/20

[58] Field of Search ..... 81/19, 20

[56] References Cited

U.S. PATENT DOCUMENTS

| | | | |
|---|---|---|---|
| 592,278 | 10/1897 | Coleman . | |
| 872,886 | 12/1907 | Bates . | |
| 1,425,369 | 8/1922 | Coleman . | |
| 1,535,685 | 4/1925 | Randell . | |
| 3,150,858 | 9/1964 | David | 254/26 |
| 4,336,832 | 6/1982 | Poulos | 81/20 |
| 4,363,344 | 12/1982 | Pollak | 81/20 |
| 4,482,132 | 11/1984 | Lamansky | 254/26 R |
| 4,561,635 | 12/1985 | Lamansky | 254/26 R |
| 4,890,518 | 1/1990 | Floyd | 81/20 |

OTHER PUBLICATIONS

Garrett Wade Tools Catalog (1990), pp. 134–135.

*Primary Examiner*—James G. Smith

*Attorney, Agent, or Firm*—Timothy H. P. Richardson

[57] ABSTRACT

A hand hammer having a striking surface which is inclined away from the user's hand.

16 Claims, 2 Drawing Sheets

HAND HAMMER

BACKGROUND OF THE INVENTION

1. Field of the Invention

This invention relates to hand hammers.

2. Introduction to the Invention

Hand hammers are available, and/or have been described in patents and other documents, in a large variety of shapes and sizes. Reference may be made for example to U.S. Pat. Nos. 592,278 (Clark), 872,886 (Bates), 1,425,369 (Coleman), 1,535,685 (Randell), 3,150,858 (David), 4,482,132 (Lamansky) and 4,561,635 (Lamansky) and to pages 134 and 135 of the Garret Wade Tools Catalog (1990), the disclosures of which are incorporated herein by reference.

SUMMARY OF THE INVENTION

When using a hammer in a confined space, especially when constructing framing for a building, it is often desirable to swing the hammer in an arc which is made difficult by adjacent structures. This results in the user swinging his arm in a way which is awkward and, therefore, tiring and liable to cause injury, such as laceration of the hand or arm against the adjacent structures. In addition, the nail may not be driven as hard and straight as it would be if the adjacent structures were not there; this increases the number of blows required and can make the desired arc of the hammer still harder to achieve as the user tries to strike a bent nail into place.

I have found that these problems can be substantially mitigated by making use of a hammer having a striking surface which is inclined outwardly, away from the user's arm. In existing hammers, by contrast, the striking surface is at right angles to the axis of the head. Surprisingly, carpenters find that no conscious change of swing is needed when working in situations which do not place any restriction on the arc of the hammer, but that in confined situations it is much easier to achieve effective nail driving. In retrospect, i.e. knowing of the improved results achieved, it appears that the inclined striking surface enables the user to move his or her arm in a natural and ergonomically efficient manner, while keeping the striking surface substantially square on the nail head, in a wider variety of the practical situations which arise in the construction of framing for buildings.

In a first aspect, this invention provides a novel hand hammer comprising (1) a handle, and (2) a head which has a substantially planar striking surface for striking nails, the handle having a single straight axis between the head and all points on the handle at which the handle can be grasped by a hand when the hammer is being used to strike a nail, and the striking surface being inclined away from the handle so that, if (a) the striking surface is held against a flat horizontal surface, and (b) the hammer is viewed horizontally, the axis of the handle is inclined to the horizontal at an angle $\phi$ which is greater than 0°, with the end of the handle adjacent the head being lower than the end of the handle remote from the head.

In a second aspect, this invention provides a novel hammer head which comprises a socket for insertion of a handle and which, when fitted with an appropriate handle having a single straight axis, provides a novel hand hammer as defined above. dr

BRIEF DESCRIPTION OF THE DRAWING

The invention is illustrated in the accompanying drawings, in which.

DETAILED DESCRIPTION OF THE INVENTION

Figure 1:
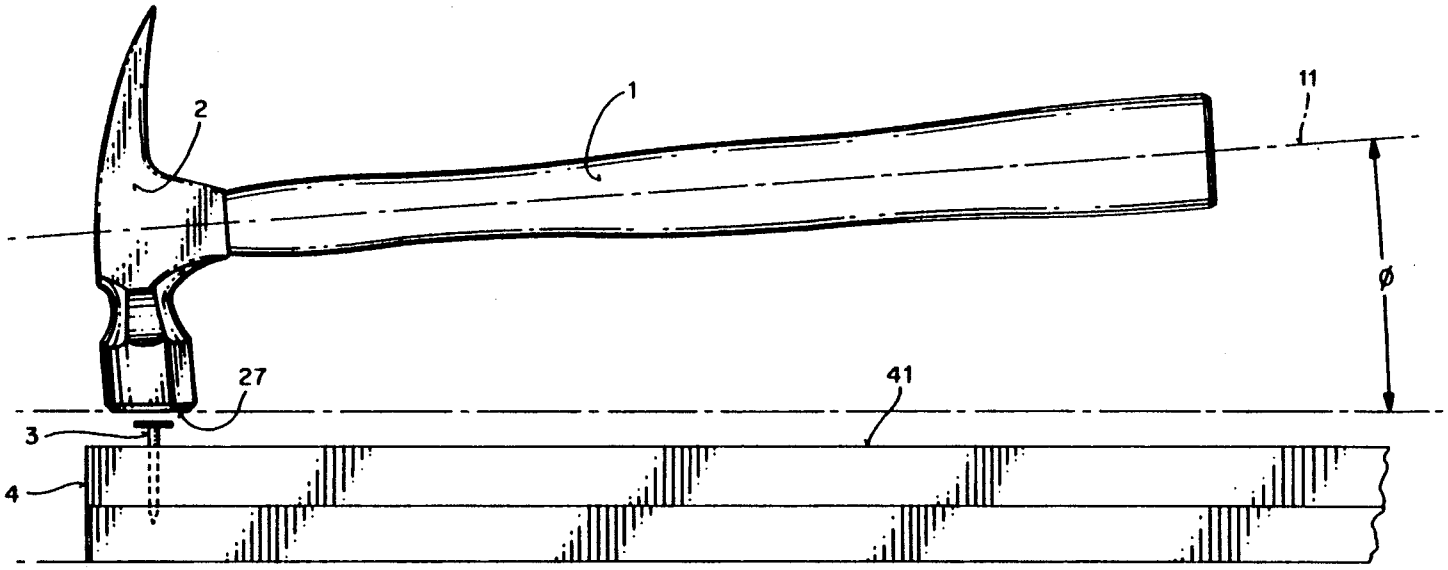
FIGS. 1, 2 and 3 are a side view, a partial bottom view, and a perspective view, of a hammer of the invention.

The hammer and hammerheads of the invention can be of conventional design apart from the inclined striking surface.

The angle of inclination of the striking surface, $\phi$, is greater than 0°, preferably at least 1.5°. If the angle is too large, for example greater than 15°, the carpenter may need to make a conscious adjustment to the way in which the hammer is swung, which is in generally undesirable. The angle $\phi$ is typically from 2.5° to 8°, preferably 3° to 5°, for example about 4°. The length of the handle of the hammer plays a part in the preferred value of $\phi$. For a framing hammer with a handle 16 to 19 inches long, the preferred value of $\phi$ is 2.5° to 10°, preferably 2.5° to 6°. For a hammer with a handle 14 to 16 inches long, the preferred value of $\phi$ is 3.5° to 12.5°, preferably 3.5° to 7°.

The term "substantially planar striking surface" is used herein to denote the parts of the hammer which actually contact nails when the hammer is in use. The striking surface can be smooth, as in a finishing hammer, or can be provided by the projecting portions of an irregular surface, e.g. a grid, designed to reduce the chance of the hammer slipping as it strikes a nail, as in a framing hammer. The irregularities should be such that the nail head will not fit between the projecting portions. A strictly planar surface is not required (though it will usually be convenient) and this term is used merely to distinguish from known hammers which are not intended for driving nails and which are deliberately made with curved, e.g. hemispherical, surfaces, e.g. for metal working.

Both the hammerhead and the handle can be of metal, for example of unitary construction, or the hammerhead can be of metal and the handle of wood.

Reference will now be made to the drawings. It is to be understood that the individual features and combinations of two or more such features which are disclosed in the drawings and the description thereof are useful in connection with the invention generally and not restricted to the particular context of the Figures in which they are illustrated.

Figure 2:
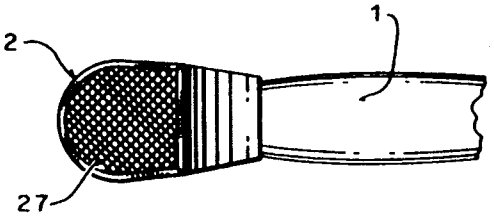
Figure 3:
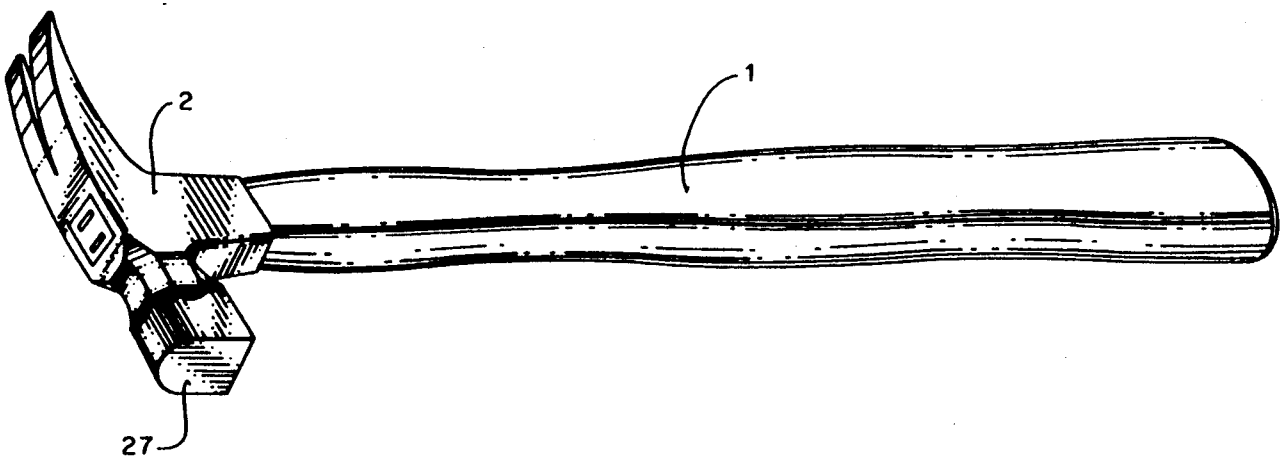

In each of the Figures, there is shown a hammer comprising a wooden handle 1 have a single, straight axis 11 and a metal head 2 having a socket into which the handle 1 is securely fitted. The head 2 has front portion which terminates in a nail-striking surface 27 which may be waffled (as sh own in FIG. 2) or smooth (as shown in FIG. 3). The head 2 also has a rear portion which comprises a conventional nail-gripping notch. FIG. 1 also shows a nail 3 which is partially embedded in a piece of wood 4 having a flat horizontal surface 41. As can be seen in FIG. 1, if the nail-striking surface 27 is held against the flat horizontal surface 41, the axis 11 of the handle is inclined to the horizontal at an angle $\phi$ which is about 4°.

I claim:

1. A hand hammer comprising (1) a handle, and (2) a head which has a substantially planar striking surface for striking nails, the handle having a single straight axis between the head and all points on the handle at which the handle can be grasped by a hand when the hammer is being used to strike a nail, and the striking surface being inclined away from the handle so that, if (a) the striking surface is held against a flat horizontal surface, and (b) the hammer is viewed horizontally, the axis of the handle is inclined to the horizontal at an angle $\phi$ which is greater than 0°, with the end of the handle adjacent the head being lower than the end of the handle remote from the head.

2. A hammer according to claim 1 wherein $\phi$ is 1.5° to 15°.

3. A hammer according to claim 1 wherein $\phi$ is 2.5° to 8°.

4. A hammer according to claim 1 wherein $\phi$ is 3° to 5°.

5. A hammer according to claim 1 wherein the handle is 16 to 19 inch long and $\phi$ is 2.5° to 10°.

6. A hammer according to claim 4 wherein at least a central part of the striking surface is provided by projecting portions of an irregular surface.

7. A hammer according to claim 1 wherein the handle is 14 to 16 inch long and $\phi$ is 3.5° to 12.5°.

8. A hammer according to claim 7 wherein at least a central part of the striking surface is provided by projecting portions of an irregular surface.

9. A hammer according to claim 1 wherein substantially all the striking surface is smooth.

10. A hammer according to claim 1 which has a metal head and a wooden handle.

11. A head for a hand hammer, the head comprising (1) a socket for the insertion of a handle, and (2) a substantially planar striking surface for striking nails, the socket and the striking surface being such that, if (a) a handle is inserted into the socket, thus creating a hammer, the handle having a single straight axis between the head and all points on the handle at which the handle can be grasped by a hand when the hammer is being used to strike a nail, (b) the striking surface is held against a flat horizontal surface, and (c) the hammer is viewed horizontally, the axis of the handle is inclined to the horizontal at an angle $\phi$ which is greater than 0°, with the end of the handle adjacent the head being lower than the end of the handle remote from the head.

12. A hammer head according to claim 11 wherein $\phi$ is 1.5° to 15°.

13. A hammer head according to claim 11 wherein $\phi$ is 2.5° to 8°.

14. A hammer head according to claim 11 wherein $\phi$ is 3° to 5°.

15. A hammer head according to claim 11 wherein $\phi$ is 2.5° to 10°.

16. A hammer head according to claim 11 wherein $\phi$ is 3.5° to 12.5°.

* * * * *